United States Patent [19]

Kipke

[11] 4,090,696

[45] May 23, 1978

[54] INTERFERING FLOW PATTERN AGITATOR

[75] Inventor: Klausdieter Kipke, Schopfheim, Germany

[73] Assignee: Ekato-Werk Erich Karl Todtenhaupt, Schopfheim, Germany

[21] Appl. No.: 750,803

[22] Filed: Dec. 15, 1976

[30] Foreign Application Priority Data

Dec. 22, 1975 Germany ..... 2557979

[51] Int. Cl.[2] ..... B01F 7/16

[52] U.S. Cl. ..... 366/327

[58] Field of Search ..... 259/107, 108, 7, 8, 259/43, 44, 23, 24, 66, 67, 122

[56] References Cited

U.S. PATENT DOCUMENTS

| | | | |
|---|---|---|---|
| 35,101 | 4/1862 | Gowdy | 259/107 |
| 138,229 | 4/1873 | Clarkson | 259/107 |
| 146,819 | 1/1874 | Govch | 259/107 |
| 1,200,301 | 10/1916 | Bigelow | 259/122 |
| 1,689,837 | 10/1928 | Lewis | 259/108 |
| 2,543,151 | 2/1951 | Cerniak | 259/108 |
| 3,064,950 | 11/1962 | De Laria | 259/108 |
| 3,241,820 | 3/1966 | Cough | 259/107 |
| 3,290,016 | 12/1966 | Lennon | 259/108 |
| 3,333,827 | 8/1967 | Lodige | 259/107 |
| 3,397,869 | 8/1968 | Webster | 259/108 |

FOREIGN PATENT DOCUMENTS

| | | | |
|---|---|---|---|
| 932,175 | 8/1955 | Germany | 259/108 |
| 2,061,882 | 6/1972 | Germany | 259/107 |
| 1,257,166 | 12/1971 | United Kingdom | 259/107 |

*Primary Examiner*—Herbert F. Ross

*Attorney, Agent, or Firm*—Michael J. Striker

[57] ABSTRACT

The present invention is directed to an agitator for dispersing media in liquids within a vessel through the formation of interfering currents within the liquid. The interfering flow pattern agitator includes a shaft turnably mounted within the vessel, at least one stirring arm with two ends, one of which is fixed to the shaft, and mounted at the other end of each stirring arm, a plurality of component blades.

18 Claims, 16 Drawing Figures

INTERFERING FLOW PATTERN AGITATOR

BACKGROUND OF THE INVENTION

Agitators have been proposed having one or more blades per stirring arm arranged radially one after the other. The proposed agitators have a pitch varying from blade to blade. According to such proposals, only solitary blades are used.

SUMMARY OF THE INVENTION

It is an object of the present invention to provide an interfering flow pattern agitator for dispersing gases and/or liquids and/or solids in liquids.

It is another object of the present invention to provide an agitator which can improve homogeneous dispersion throughout a liquid regardless of the filling level of the vessel.

It is still another object of the present invention to provide an agitator having a blade which comprises a plurality of component sub-blades arranged in cascade.

It is a further object of the present invention to provide an agitator having at least one inner blade and at least one outer blade per stirring arm, with the outer blade being composed of a plurality of component sub-blades.

The invention is directed to an interfering flow pattern agitator. According to the invention, the component sub-blades generate opposing flow-patterns within a liquid. The opposing flow-patterns originate an interfering fluid motion in the form of cascading currents. Rather than flowing around the profile of a single blade, the liquid flows around a formation of profiles of component sub-blades comprising each blade. Because the component sub-blades are arranged in the form of a cascade, the flow of the liquid is more violently and consistently deflected behind the plane of the component blades, which was achieved with the solitary blades of the prior art only in the immediate vicinity of the blades. The resultant interference flow pattern arises from the use of component sub-blades forming an outer blade. By using such component sub-blades, the resulting flow can be primarily axial, with the axial component of the flow predominating over the radial and tangential components. It is beneficial to magnify the axial flow component because the efficiency of dispersion is considerably improved with an increased axial component.

The interfering flow pattern will be influenced by the pitch or inclination of the component sub-blades relative to the plane of rotation of the shaft. In order to generate a radial flow, the component sub-blades can be arranged parallel to the axis of the drive shaft. In order to create an axial flow, the component sub-blades can be inclined at angles of less than 90° with the plane of rotation. In order to design the particular nature of the axial flow, the inclinations of the component sub-blades may be directed outwardly or inwardly, or in the same or opposite directions.

Advantageously, the component sub-blades are parallel and spaced apart from each other. The widths and/or lengths of the component sub-blades may be different or equal. The component sub-blades can also be staggered relative to one another in the circumferential direction.

At their leading edges, the agitator blades in general and the component sub-blades in particular can be advantageously profiled for optimum fluid flow (e.g. somewhat like an airfoil). The profile may be designed to be a solid section or, perhaps for reasons of manufacturing and material economy, hollow.

The component sub-blades will advantageously be mounted on a connecting piece intermediate the sub-blades and the stirring arm. At their outer ends (i.e. opposite the connecting piece) the component sub-blades can also be connected by a bridge; thus a box-like structure having an open interior is formed. The liquid and the medium can then flow through the open interior during the operation of the box-like component sub-blades. Instead of an approximately rectangular hollow cross-section of the box shape, one can choose a tube with an annular cross-section or with a hollow elliptic cross-section.

Advantageously, the component sub-blades are disposed in an arrow-shaped arrangement. In other words, it is advantageous that the sub-blades converge to the connecting piece with the angles made by each converging sub-blade and the respective end of the connecting piece being equal. In the arrow-shaped arrangement, it is advantageous for the sub-blades to be similarly or else oppositely inclined in circumferential direction forwardly and/or rearwardly relative to a plane perpendicular to the radial direction.

As an example illustrating the interplay of some of the above-mentioned factors, radial flow may be generated by positioning the component sub-blades so that they are approximately vertical relative to the surface of the liquid with each sub-blade positioned below the stirring arm so that the latter sweeps over the component sub-blades, with each sub-blade forming an acute angle relative to the longitudinal center line of the stirring arm.

It is also frequently advantageous to incline the sub-blades along different angles from the plane of rotation. The inclinations may be towards the same direction or opposite directions, for example.

Finally, it is frequently advisable to axially offset the outer blade relative to the inner blade, to improve the operating characteristics as the blades are submerged into the liquid.

The invention is directed to an interfering flow pattern agitator for dispersion of media within liquid in a vessel. The particular form of the agitator is useful especially because of the unusual shape of the outer blades of the agitator, their pitch and the pitch of the stirring arms. The novel features which are considered as characteristic for the invention are set forth in particular in the appended claims. The invention itself, however, both as to its construction and method of operation, together with additional objects and advantages thereof, will be best understood from the following description of specific embodiments when read in connection with the accompanying drawings.

BRIEF DESCRIPTION OF THE DRAWINGS

FIGS. 3*a* –3*m* show different embodiments of the present invention in which the component sub-blades vary in shape, pitch, number, dimensions and positioning.

DESCRIPTION OF THE PREFERRED EMBODIMENTS

Figure 1:
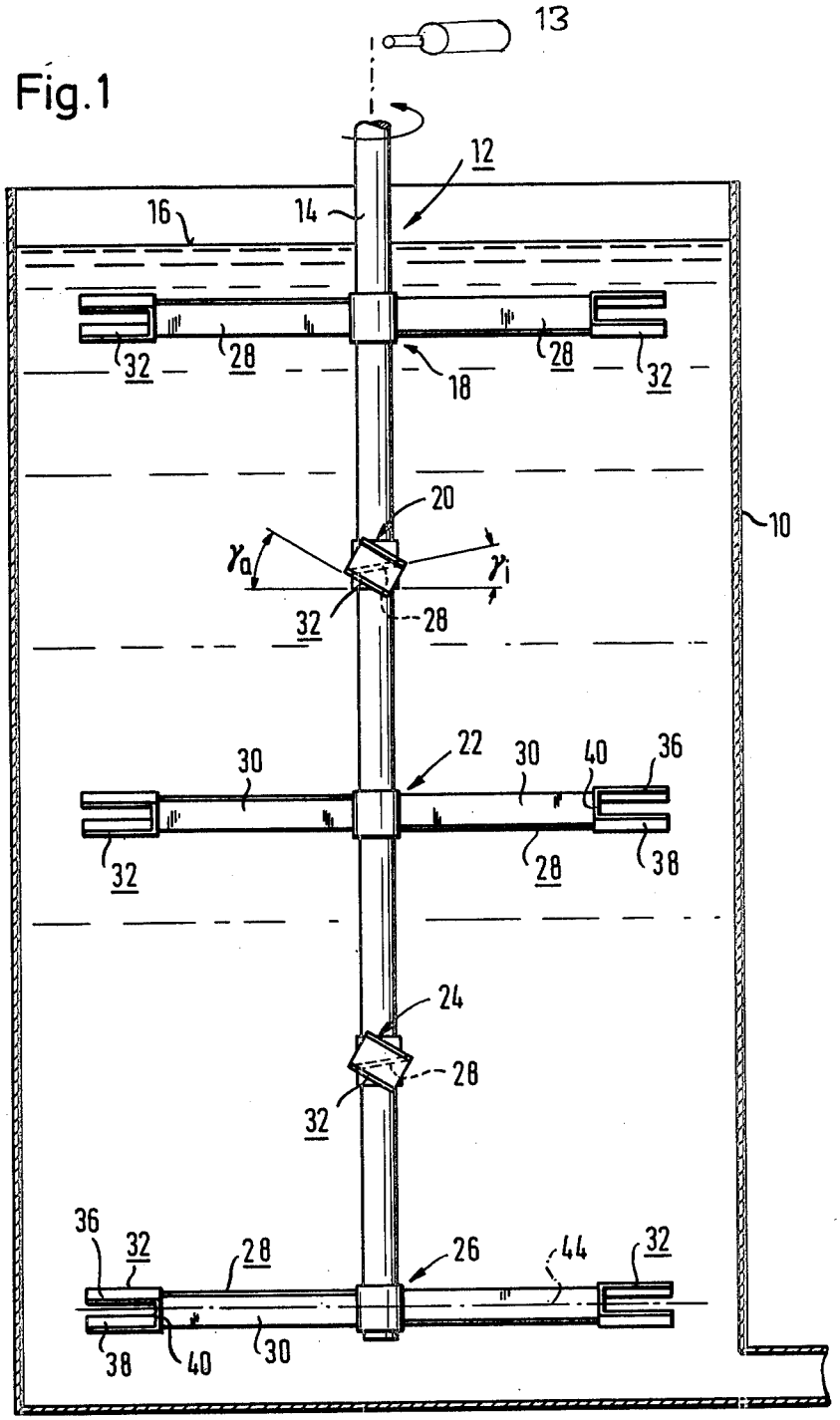
FIG. 1 is a schematic lateral cutaway view of an embodiment of an interfering flow pattern agitator.
Figure 2A:
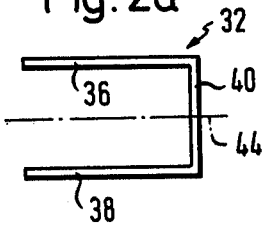
FIGS. 2*a*, 2*b* and 2*c* are respectively lateral, top and front views of an embodiment of the present invention in which the component sub-blades of the outer blade are parallel to each other and to a plane perpendicular to a vertical drive shaft.
Figure 2B:
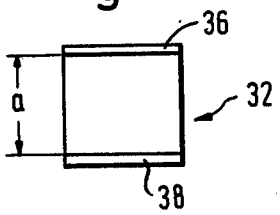
Figure 2C:
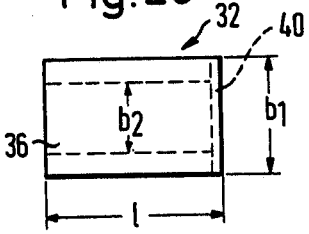

Referring to FIG. 1, an agitator 12 placed in vessel 10 is rotatable around a shaft 14 which is driven by motor 13. The shaft is preferably vertical. Mounted on the shaft 14 of the agitator 12, five impellers 18, 20, 22, 24 and 26 are set apart in superposed horizontal planes. In the illustrated embodiment, all of the impellers are below the liquid surface 16. The agitator 12 can of course have a different number of impellers than are shown in the illustrated embodiment. The single impellers 18–26 can be arranged in the same alignment, one above the other, or they may be staggered so that intervening regularly between impellers of similar orientation are impellers oriented in a direction different by 90° or the like. The diameters of the single impellers can be different; therefore, the dimensions of the impellers can be chosen to be proportionate to any vessel shape.

Each impeller 18–26 is provided with at least one stirring arm 28. In FIG. 1, two stirring arms 28 per impeller are provided. The stirring arms 28 are arranged in the plane of rotation of the agitator, with each stirring arm being separated by an angle of 180° or the like. Also, the stirring arms 28 can be designed such that each stirring arm is bent. For example, an inner part supporting an inner blade of the stirring arm 28 may be bent in an acute angle relative to the shaft 14, while an outer part of the stirring arm supporting an outer blade can be oriented so that the outer part is perpendicular to a plane parallel to shaft 14. As illustrated in FIG. 1, this outer part would, therefore, be horizontal. Furthermore, the stirring arms 28 can be arranged with their longitudinal axes set apart and parallel to a plane of rotation.

Each stirring arm 28 includes an inner blade 30 and an outer blade 32. Preferably, there is only one inner blade per stirring arm. However, for appropriate circumstances, the inner blades may be composed of several component sub-blade analogously to the outer blades. The inner blade 30 may, for example, be inclined from a plane perpendicular to the shaft by an angle $\gamma i$ and the outer blade 32 may be inclined from such a plane by an angle $\gamma a$; $\gamma i$ and $\gamma a$ may be different or equal and are preferably between 0° and about 60°. The relative pitch caused by these inclinations is preferably designed such that the pitch of the inner blade is inverse to the pitch of the outer blade. In other words, if the inner blade is inclined so that a downward flow is generated, then the outer blade is preferably inclined so that an upward flow is generated. Such a design improves the interference of the generated flow pattern. The pitch of the inner blades 30 and the outer blades 32 relative to a plane perpendicular to the shaft may be constant throughout the agitator or may vary from stage to stage, i.e. from one impeller to another.

Referring to FIGS. *2a, 2b* and *2c*, the outer blade 32 has, in its basic form, two component sub-blades 36 and 38. The sub-blades 36, 38 are connected by a cross-piece or connecting piece 40. Referring to FIG. 1, the component sub-blades 36 and 38 are arranged with their lengths parallel to the center line or axis 44 of the stirring arm 28. The connecting piece 40 is connected to the stirring arm 28, and is in a plane perpendicular to the axis 44 of the stirring arm 28. The component sub-blades are arranged longitudinally parallel to a plane perpendicular to the shaft 14 and are set apart from each other. The distance of separation may be about equal to width "*b*" of a component sub-blade. Where more than two component sub-blades form an outer blade 32, the distances of separation can be different.

FIGS. *3a* through *3m* show modifications of the basic embodiment of the outer blades. Referring to FIG. *3a*, there may be more than two component sub-blades per outer blade. While FIG. *3a* shows three sub-blades, the number of component blades is not restricted to a maximum of three.

Referring to FIG. *3b*, the dimensions of the component sub-blades may be different. In FIG. *3b*, the lengths of the component sub-blades 36 and 38 are different, i.e. the length $l_1$ of component sub-blade 36 is greater than the length $l_2$ of component blade 38. Alternatively, component sub-blade 38 may be longer than sub-blade 36. The width "*b*" may also be different.

Referring to FIG. *3c* showing a front view of an outer blade 32, parallel and longitudinally equal component sub-blades are positioned such that the leading edge of sub-blade 38 is ahead of the corresponding edge of sub-blade 36. Reference letter "*c*" represents the displacement of sub-blade 38 relative to sub-blade 36. The sub-blades are arranged in a plane perpendicular to the axis 44 of the stirring arm 28, and "δ" represents the angle of offset between the parallel sub-blades. Angle δ is preferably between about −60° and +60°.

Referring to FIG. *3d* showing a lateral view of an outer blade 32, component sub-blades 36 and 38 may be differently inclined relative to axis 44 such that the sub-blades are not parallel either to each other or to the axis 44. Sub-blade 36 forms an angle $\beta_2$ and sub-blade 38 forms an angle $\beta_1$ with respect to the axis 44. These angles may be different or equal. The component sub-blades 36 and 38 are spread outwardly up and down relative to axis 44. Alternatively, at least one of the sub-blades can be inclined inwardly towards the axis 44. This inward inclination is illustrated by the dotted line for sub-blade 38 forming angle $\beta_3$ relative to axis 44. The angles $\beta_1$, $\beta_2$ and $\beta_3$ are appropriately measured from a point to which the sub-blade would converge without changing its inclination to intersect with axis 44. Preferably, all of these angles are acute and are between 0° and 30°.

Referring to FIG. *3e* showing a front view of an outer blade, component sub-blades 36 and 38 may form angles $\alpha_2$ and $\alpha_1$, respectively, relative to the plane of rotation E. The flow caused by rotation of these sub-blades could then be in the direction of the arrow P1 as well as P2. The angles $\alpha_2$ and $\alpha_1$ may be different or equal. The pitch or inclination of the component sub-blades may be inverse, as is shown by FIG. *3e*. However, each sub-blade may have the same pitch relative to the plane of rotation. The dotted line for sub-blade 38 shows that sub-blade having the same pitch as sub-blade 36. Alternatively, sub-blade 38 may still be oriented inwardly with respect to the plane of rotation, but with angle $\alpha_3$ of the dotted line position of sub-blade 38 being different from angle $\alpha_2$ of sub-blade 36. Angles $\alpha_1$, $\alpha_2$ and $\alpha_3$ are preferably acute and are between about 0° and about 30°.

Referring to FIG. *3f*, the outer blade 32 may be disposed above or below axis 44 of the inner blade 30 so that the outer blade is parallel to the shaft 14. The center of the outer blade 45 is at a distance "*d*" from the center or axis 44 of the inner blade 30. Preferably, the distance "*d*" extends downwardly from the axis 44. The embodiment of the invention shown in FIG. *3f* makes possible an improved dispersion.

Figure 3A:
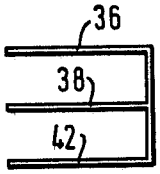
Figure 3D:
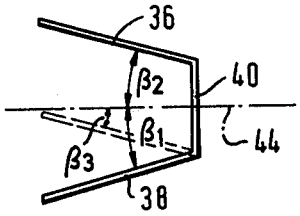
Figure 3B:
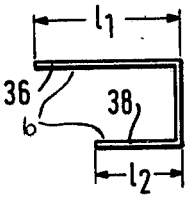
Figure 3E:
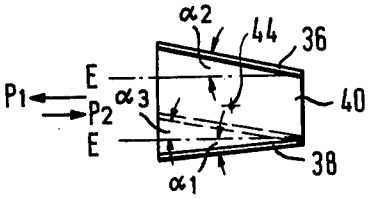
Figure 3F:
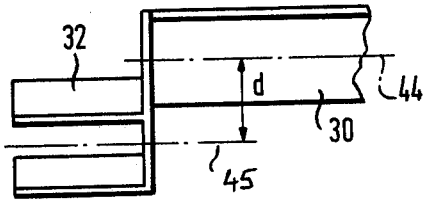
Figure 3C:
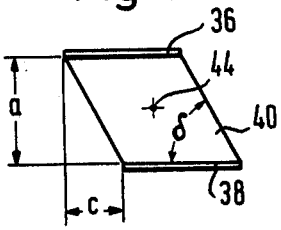
Figure 3G:
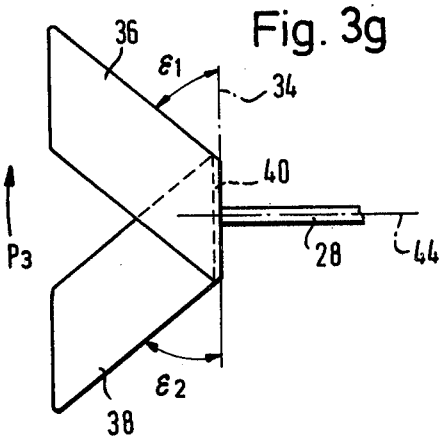

Referring to FIG. 3*g* showing a top view of an outer blade shaped like an inverse arrow, the axis 44 of stirring arm proceeds in the plane of rotation which is swept over by the stirring arm. Auxiliary line 34 is also in the plane of rotation of the stirring arm; however it is perpendicular to the center line or axis 44 of stirring arm 28. Component sub-blades 36 and 38 are arranged respectively at angles $\epsilon_1$ and $\epsilon_2$ relative to line 34. Where arrow P3 represents the direction of rotation of stirring arm 28, component blade 36 is inclined forwardly in the direction of the rotation and the lower component blade 38 is inclined backwardly inverse to the direction of rotation. Angles $\epsilon_1$ and $\epsilon_2$ may be different or equal but are preferably between 0° and about 150°. For suitable circumstances, sub-blades 36 and 38 may be inclined in the same direction instead of in opposite directions. Alternatively, each sub-blade may be inclined forward or each may be inclined backwards but with angles $\epsilon_1$ and $\epsilon_2$ being different. The embodiment illustrated by FIG. 3*g* is also appropriate for use where the inner blade 30 is inclined at an angle $\gamma a$ (shown in FIG. 1) and where component sub-blades form any of different angles $\alpha_1$, $\alpha_2$ and $\alpha_3$ relative to the plane of rotation E (shown in FIG. 3*e*).

Figure 3H:
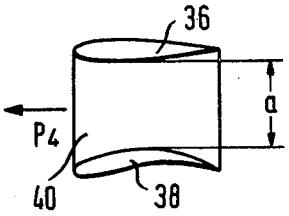

Referring to FIG. 3*h* showing a front view of an outer blade, component sub-blades 36 and 38 may be profiled advantageously from the point of view of fluid mechanics. The sub-blades may be shaped to be a solid section or, for functional efficiency and material economy, hollow. The arrow P4 marks the direction of rotation.

Figure 3I:
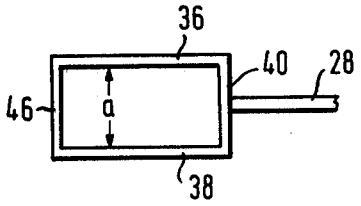
Figure 3K:
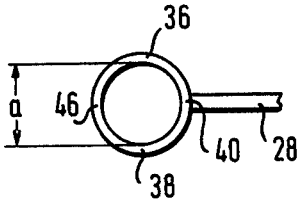

Referring to FIGS. 3*i* and 3*k* showing top view of the outer blades, the sub-blades 36 and 38 may be connected at their outer ends by a bridge 46; thus, an open box blade is formed with flow passing through the hollow interior. Alternatively, a tubular shaped blade with a hollow interior can be made, as shown in FIG. 3*k*. The tubular shaped outer blade may have a circular cross-section as is illustrated or it may have an elliptic cross-section or the like. Preferably, the box-like or tubular blades are inclined by an angle $\gamma a$ to the plane of rotation (see FIG. 1).

Figure 3L:
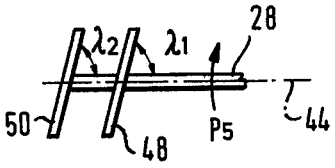

Referring to FIG. 3*l* showing a top view of an outer blade, radial flow may be generated by joining component blades 48 and 50 in tandem along the axis of the stirring arm 28. The sub-blades respectively form angles $\tau_1$ and $\tau_2$ relative to axis 44. These angles may be different or equal but they are preferably between about 70° and 110°. The sub-blades 48 and 50 may be positioned so that they are vertical with respect to the surface of the liquid. Preferably, the sub-blades are located below the stirring arm although they may be located above the stirring arms. The sub-blades may also be inclined relative to a plane parallel to the vertical shaft 14 and they may also be non-parallel relative to each other.

Figure 3M:
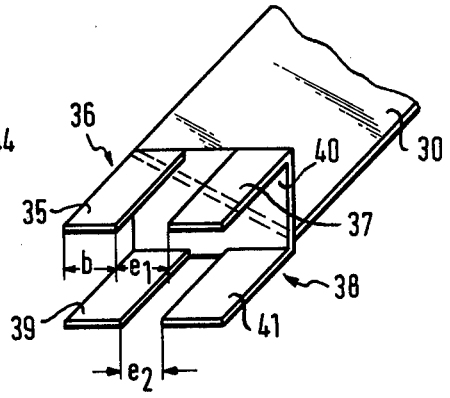

Referring to FIG. 3*m*, the component sub-blades 36 and 38 may be subdivided into sub-blade sections 35, 37 and 39, 41 respectively. The sections 35 and 37 are spaced apart by a distance *e*1 and the sub-blade sections 39 and 41 are spaced apart by a distance *e*2. The distances *e*1 and *e*2 may be different or equal. The sub-blade sections 35, 37 and 39, 41 may be arranged so that the sections are parallel or inclined relative to each other. Each sub-blade section may have a width, length or pitch which is different or equal to the corresponding characteristic of another sub-blade section. The distances *e*1 and *e*2 may approximate the width "*b*" of the component sub-blade sections or they may be greater or smaller than "*b*". The dotted line in FIG. 3*m* shows how the outer blade consisting of the sub-blade sections may be inclined with respect to the inner blade.

The outer blades may be designed in the form of rectangles, trapezoids, circles, ellipses or segments having circular, elliptic or parabolic sections. The blades may be designed as planar or convex or they may be bent at least once, providing a shape having a convex form.

It will be understood that each of the elements described above, or two or more together, may also find a useful application in other types of agitators differing from the types described above.

While the invention has been illustrated and described as embodied in an interfering flow pattern agitator, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An interfering flow pattern agitator for dispersing media in liquids within a vessel, comprising in combination a shaft mounted for rotation within the vessel about an upright axis; at least one rectilinear stirring arm projecting from said shaft transversely of said axis and having an inner end fixed to said shaft and an outer end remote from said inner end; and a pair of interference-flow producing component sub-blades mounted on said outer end of said arm, said inner end forming an inner blade inclined along an acute angle from a plane perpendicular to said shaft, said sub-blades being inclined along an acute angle from a plane perpendicular to said shaft and inverse to the inclination of said inner blade, said sub-blades being so spaced from one another that the flow patterns produced by the respective sub-blades interfere with one another with a resulting reduction in flow resistance, whereby opposing flow patterns cause an interfering fluid motion in the form of cascading currents.

2. An agitator as defined in claim 1, wherein said shaft is vertical.

3. An agitator as defined in claim 2, wherein each stirring arm is shaped as a blade, whereby said stirring arm forms an inner blade.

4. An agitator as defined in claim 1, wherein said component sub-blades are parallel to each other.

5. An agitator as defined in claim 4, wherein the lengths of said component sub-blades are inclined along an acute angle from a plane perpendicular to said shaft.

6. An agitator as defined in claim 5, wherein the component sub-blades are tandem joined below said inner blade and are vertical to the surface of the liquid.

7. An agitator as defined in claim 6, wherein said component sub-blades are adjustable to different orientations.

8. An agitator as defined in claim 1, wherein the lengths of said component sub-blades are inclined in different directions relative to a plane perpendicular to said shaft.

9. An agitator as defined in claim 1, wherein the dimensions of each component sub-blade are different.

10. An agitator as defined in claim 1, wherein each component sub-blade further comprises at least two sub-blade sections spaced apart.

11. An agitator as defined in claim 10, wherein the sub-blade sections of opposing component sub-blades are arranged parallel to each other.

12. An agitator as defined in claim 11, wherein the spacing between sub-blade sections of different component sub-blades is constant.

13. An agitator as defined in claim 10, wherein the spacing between sub-blade sections varies among the different component sub-blades.

14. An agitator as defined in claim 1, wherein each end of each component sub-blade is connected to the corresponding end of another component sub-blade.

15. An agitator as defined in claim 14, wherein the connected component sub-blades form tubes.

16. An agitator as defined in claim 14, wherein the connected component sub-blades are part of a rectangle.

17. An agitator as defined in claim 3, wherein the pitch of the component sub-blades in each plane is the same as that of the blades in all the other planes.

18. An agitator as defined in claim 3, wherein the pitch of the blades varies from one to the next of said planes.

* * * * *